US007766452B2

(12) United States Patent
Ohashi

(10) Patent No.: US 7,766,452 B2
(45) Date of Patent: Aug. 3, 2010

(54) INK JET RECORDING HEAD, LIQUID STORAGE CONTAINER AND INK JET RECORDING APPARATUS

(75) Inventor: Tetsuya Ohashi, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/123,298

(22) Filed: May 19, 2008

(65) Prior Publication Data

US 2008/0218555 A1 Sep. 11, 2008

Related U.S. Application Data

(63) Continuation of application No. 11/286,782, filed on Nov. 23, 2005, now Pat. No. 7,387,360.

(30) Foreign Application Priority Data

Nov. 26, 2004 (JP) ..... 2004-342248

(51) Int. Cl.
*B41J 19/18* (2006.01)

(52) U.S. Cl. ..... 347/37; 347/5; 347/19

(58) Field of Classification Search ..... 347/19, 347/37, 5, 9, 12
See application file for complete search history.

(56) References Cited

U.S. PATENT DOCUMENTS 6,547,363 B1 * 4/2003 Shinada et al. ..... 347/19
6,601,944 B1 * 8/2003 Kawazoe ..... 347/37

FOREIGN PATENT DOCUMENTS

JP 2001-179961 7/2001

* cited by examiner

*Primary Examiner*—Lam S Nguyen
(74) *Attorney, Agent, or Firm*—Canon USA Inc IP Div

(57) ABSTRACT

An ink jet recording head is detachably attached to an ink jet recording apparatus including a carriage operable to reciprocally move and an optical encoder scale. An ink jet recording head, a liquid storage container, or an ink jet recording apparatus includes at least one of a light emitting element configured to emit light to an encoder scale and a light receiving element configured to receive light through the encoder scale.

7 Claims, 7 Drawing Sheets

INK JET RECORDING HEAD, LIQUID STORAGE CONTAINER AND INK JET RECORDING APPARATUS

CROSS-REFERENCE TO RELATED APPLICATIONS

This application is a continuation of U.S. patent application Ser. No. 11/286,782 filed Nov. 23, 2005, which claims priority from Japanese Patent Application No. 2004-342248 filed Nov. 26, 2004, all of which are hereby incorporated by reference herein in their entirety.

BACKGROUND OF THE INVENTION

1. Field of the Invention

The present invention relates to an ink jet recording head, a liquid storage container for containing liquid, and an ink jet recording apparatus, which discharges a liquid on a recording medium such as paper, or cloth.

2. Description of the Related Art

In general, a serial scan type ink jet recording apparatus performs recording by discharging ink on a recording medium from a recording unit, i.e. an ink jet recording head.

The ink jet recording apparatus has advantages in that the recording unit can be easily made compact, a high-definition image can be recorded at high speed, and the like.

In such recording apparatus, ink must be discharged in a timing that a desired image is formed on the recording medium according to the moving position of a carriage.

Therefore, the ink jet recording apparatus is generally provided with a linear encoder to detect the position of the carriage.

The linear encoder is stretched across in a moving direction of the carriage, and includes an encoder scale, which is a reference to detect a moving distance of the carriage, and a sensor attached to the carriage which detects a moving distance of the carriage.

FIG. 8 is a perspective view showing the configuration of a conventional recording apparatus.

The conventional recording apparatus includes a recording head 1, a carriage 2, a carriage board 3, a linear encoder sensor 4, and a linear encoder scale 55.

Further, the conventional recording apparatus includes a main body chassis 6, two guide shafts 7, a leaf spring 9, a screw 10, a timing belt 11, an idle pulley 12, and a driving motor 13.

The main body chassis 6 is a casing for the recording apparatus, and the two guide shafts 7, the idle pulley 12, and the driving motor 13 are mounted on the main body chassis 6, respectively.

The two guide shafts 7 are disposed in parallel with each other, and the idle pulley 12 and the driving motor 13 are disposed on the same side of the main body chassis 6.

Between the idle pulley 12 and a pulley (not shown) provided to the driving motor 13, a piece of the timing belt 11 is stretched across in parallel with the guide shaft 7.

Further, the main body chassis 6 is provided with the leaf spring 9.

The leaf spring 9 is fixed by the screw 10 to one side of the main body chassis 6 to which both ends of the two guide shafts 7 are attached.

One end of the linear encoder scale 55 is fixed to the side of the main body chassis 6, and the other end is connected to the leaf spring 9 so as to be disposed in parallel with the guide shaft 7 while being pulled by proper tension.

The carriage 2 mounted with the recording head 1 is supported by the guide shaft 7 so as to slide along the guide shaft 7.

A portion of the timing belt 11 is connected to the carriage 2, and by rotation of the driving motor 13, the carriage 2 can be moved along the guide shaft 7.

The linear encoder sensor 4 is fixed on the carriage 2 with the carriage board 3, and is arranged so as to nip the linear encoder scale 55.

When the carriage 2 moves along the guide shaft 7 driven by the driving motor 13, the linear encoder sensor 4 connected to the carriage 2 also moves along the linear encoder scale 55.

The linear encoder sensor 4 converts positional information on the liner encoder scale 55 into a pulse signal.

The linear encoder sensor 4 transmits the pulse signal to a main board (not shown) via a flexible cable (not shown) and the like from the carriage board 3, and to an arithmetic unit (not shown) on the main board.

The arithmetic unit controls the position and the speed of the carriage 2 based on the pulse signal.

There are various types of linear encoders, such as a magnetic type and an optical type. The linear encoder of the magnetic type has a magnetic sensor and a scale configured of a metallic shaft or a sheet material to which magnetic information is given at a constant pitch.

As the optical linear encoder, in addition to a light emitting element and a light receiving element, one type has a scale with dark and light patterns of a constant pitch. Another type has a scale with an uneven shape of a constant pitch, and so forth.

The various types of linear encoders above described have advantages and disadvantages, respectively.

The magnetic linear encoder has an advantage in that, even when there is a slight ink contamination, it does not affect the performance of the encoder.

On the other hand, there are disadvantages in that it is difficult to make the magnetic linear encoder of high resolution, and hard to widen a gap between the encoder scale and the encoder. In addition, there is a problem of accuracy in mounting, and the gap is prone to be clogged by matter.

Further, in the case of the magnetic linear encoder, caution is required in handling magnetic tools and the like.

In the optical type linear encoder, high resolution can be easily obtained, and it is easy to make the gap between the encoder scale and the encoder sensor relatively wider.

In addition, it can be easily assembled. However, there is the disadvantage in that the performance can sharply deteriorate by ink contamination.

With respect to the conventional recording apparatus which is described above, even in the case of the popular and low cost apparatus, high resolution and high accuracy have been noticeably achieved, and an apparatus has begun to appear which shoots ink at a pitch of 1200 dots per 25.4 mm (one inch).

In the case where ink is shot at such intervals, needless to say, an ink shooting speed is required to increase, and moreover, high resolution is required of the linear encoder.

Naturally, it is ideal to use a linear encoder having a resolution of 1200 or more dots per 25.4 mm for a printer having 1200 dots per 25.4 mm.

However, because of a limit to the cost and the size, a linear encoder has been often used in which 300 dots or 600 dots per 25.4 mm are multiplied.

In recent years, a linear encoder having 1200 dots per 25.4 mm can be made at a low cost, and such a type that can be used for the general printer has begun to appear.

However, the influence arising from a shift of the phase and the amplitude of the output signal of the sensor which is generated by the contamination of the parts by ink and the like has become apparent as the preciseness of the linear encoder is increased, and is not negligible.

U.S. Pat. No. 6,264,303 discloses a cleaning member which slides against the linear scale of the optical encoder and removes a surface contamination.

Japanese Patent Application Laid-Open No. 2000-141802 discloses a method in which the cleaning member abuts against and separates from the linear scale.

Japanese Patent Application Laid-Open No. 2001-121721 discloses a cleaning timing and the situation under which the cleaning is performed.

However, in the case of the optical linear encoder where a ray to be sensed is required to be focused at the sensor side in order to detect a position, the contamination of the sensor has much larger effect than the contamination of the scale.

Further, associated with high resolution of the linear encoder, the ink droplet to be used has become small, and as a result, minute ink (hereinafter referred to as ink mist) is generated that cannot shoot on the recording medium.

Since this ink mist is extremely minute, it is prone to soar to the position of the linear encoder associated with the movement of the carriage. Accordingly, there is a great possibility that the mist enters into the sensor of the linear encoder.

Thus, it has become evident that the sensor of the linear encoder is often contaminated earlier than the scale of the linear encoder.

As described above, in the conventional apparatus, even when the cleaning of the encoder itself is performed, if the ink mist adheres to the detection sensor, durability of the linear encoder deteriorates.

There have been also problems such as disarray of print images and shutdown of the apparatus due to a reading error.

With respect of the contamination of the encoder scale, the replacement thereof by periodic servicing or the cleaning of the surface by the user himself can be easily performed.

However, with respect to the contamination of the detection sensor of the linear encoder, since a light emitting unit and a light receiving unit are integrally configured, it is extremely difficult to perform the cleaning.

Further, since these units are configured integrally with the recording apparatus, it is not possible to replace the sensor of the linear encoder unless the recording apparatus is dismantled and taken out.

In the case where a replacement need arises, the user is forced to put up with an extreme inconvenience of sending the main body to the customer service department to replace the parts thereof.

SUMMARY OF THE INVENTION

The present invention has been made in view of the above described problems.

The present invention is directed to a liquid storage container, an ink jet recording head, and an ink jet recording apparatus, which can reduce a reading error of a light transmission type linear encoder due to mist contamination without performing any particular operation.

In one aspect of the present invention, an ink jet recording head detachably attached to an ink jet recording apparatus having a carriage that makes a reciprocal motion along the recording medium and an optical encoder scale, includes at least one of a light emitting unit configured to emit light to the encoder scale and a light receiving unit configured to receive light through the encoder scale.

Further, in one embodiment of the present invention, the ink jet recording head has the light emitting unit. Further, the ink jet recording head has integrally an ink storage unit adapted to contain ink.

In another aspect of the present invention, a liquid storage container detachably attached to an ink jet recording apparatus includes a carriage configured to reciprocally move along a recorded medium and an optical encoder scale has at least one of a light emitting unit configured to emit light to the encoder scale and a light receiving unit configured to receive light through the encoder scale.

Further, in one embodiment, the liquid storage container includes the light emitting unit as its feature.

Further, the liquid storage container has a board that includes the light emitting unit and an information recording element configured to hold information relating to the liquid storage container.

In a further aspect of the present invention, an ink jet recording apparatus includes a carriage configured to reciprocally move along a recording medium, an optical encoder scale, an ink jet recording head having a light emitting unit configured to emit light to the encoder scale, and the carriage having a light receiving unit configured to receive light from the light emitting unit through the encoder scale.

In the present invention, at least one of the light emitting unit (light emitting diode (LED)) of the linear encoder for performing the position detection of the carriage of the recording apparatus and the light receiving sensor is provided in the ink jet recording head or the liquid storage container detachably attached to the recording apparatus.

In these configurations, the light emitting unit and the light receiving unit can be periodically exchanged together with the detachable and attachable component parts before the adhesive contamination of the mist and the like arisen from printing is piled up.

Consequently, the occurrence of the malfunction and the print failure of the recording apparatus can be reduced.

Further, since the light emitting unit and the light receiving sensor can be configured to be detachably attached to the recording apparatus, the contamination of the light emitting unit and the light receiving sensor can be easily removed without a heavy operation.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE EMBODIMENTS

Embodiments of the invention will be described in detail below with reference to the drawings.

First Embodiment

Figure 7:
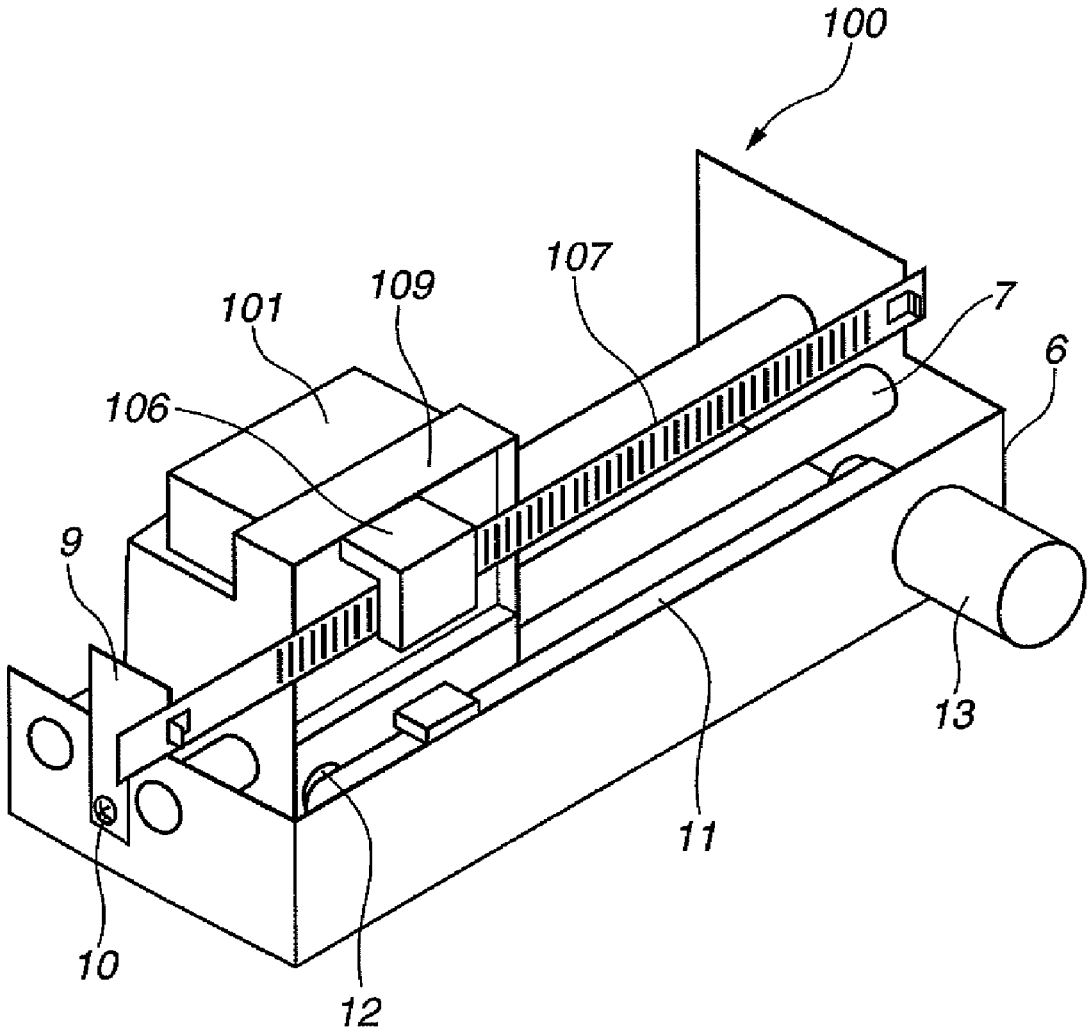
FIG. 7 is a perspective view of the ink jet recording apparatus according to the first embodiment of the present invention.
Figure 8:
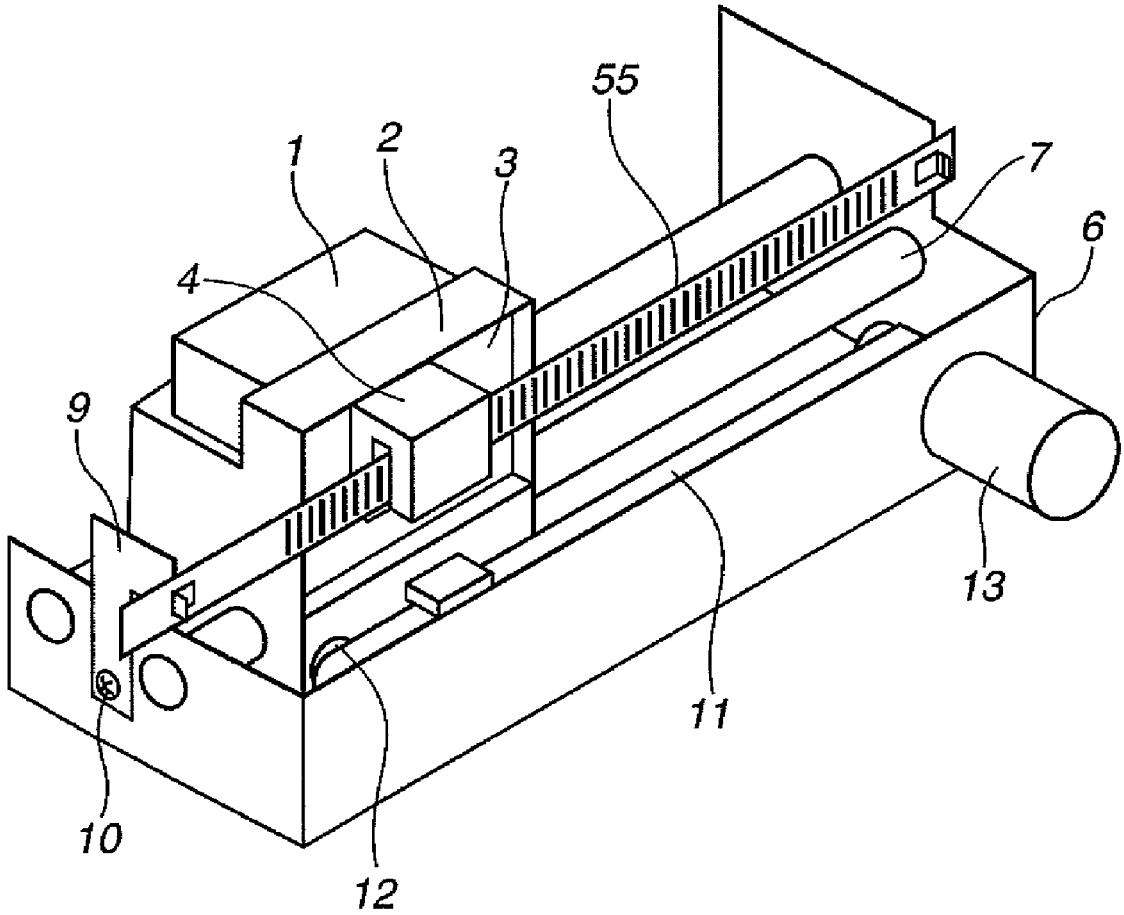
FIG.8 PRIOR ART
FIG. 8 is a perspective view of a conventional ink jet recording apparatus.

FIG. 7 is a perspective view of an ink jet recording apparatus 100 according to a first embodiment of the present invention.

In FIG. 7, reference numeral 101 denotes a recording head that constitutes a recording unit, which is configured to be detachably attached to the ink jet recording apparatus 100.

Figure 1:
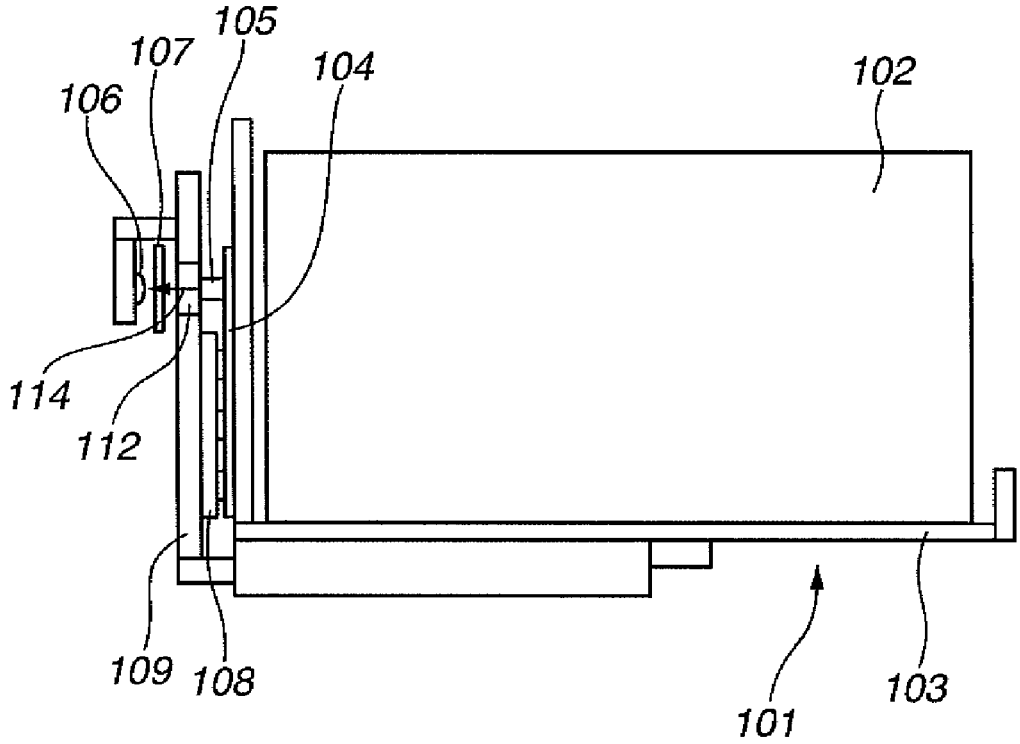
FIG. 1 is a schematic cross sectional view of an ink jet recording head unit according to a first embodiment of the present invention.

FIG. 1 is a schematic cross sectional view showing a cross section in the ink jet recording head unit in the first embodiment.

Reference numeral 102 denotes an ink tank, and reference numeral 103 denotes a holder unit that holds the ink tank 102.

The first embodiment will describe a configuration having the ink tank 102 detachably attached to the holder unit 103.

The holder unit 103 is configured to be integrated with the recording head chip, and a tank containing ink is detachably attached.

The recording head may be of a disposable type in which a chip unit that performs discharging and an ink tank are integrally configured and cannot be separated.

Reference numeral 104 denotes an electric board that transmits an electric signal such as a driving signal associated with ink discharging in the ink jet recording apparatus main body and the recording head 101.

Reference numeral 109 denotes a printer carriage as a transport unit to be mounted with the recording head 101, and the recording head 101 scans the recording medium by the printer carriage 109.

Reference numeral 108 denotes a connector board provided in the printer carriage 109, and having an electric connecting point to perform an electric connection between the recording head 101 and the recording apparatus 100.

Reference numeral 107 is an optical encoder scale that shows positional information in a scanning direction, and uses a scale having a light shielding portion printed on a transparent polyester film.

The encoder scale 107, as another configuration, may use a multi-layer metallic thin plate and the like, such as Ni—Cu—Ni, provided with a light transmission slit.

Reference numeral 106 denotes a light receiving sensor as a position detection unit to read the encoder scale 107 and detect positional information, in which a photo transistor is arranged. The light receiving sensor 106 is electrically connected to the control unit (not shown) of the recording apparatus 100 through an FPC (flexible print cable) and the carriage board (both not shown).

Reference numeral 105 denotes a light emitting diode (LED) 105, which emits light that passes through the encoder scale 107 toward the light receiving sensor 106.

The light receiving sensor 106 is fixed to the printer carriage 109, and the LED 105 is fixed to the recording head 101 opposed to the light receiving sensor 106 where the photo transistor is arranged.

Reference numeral 112 is an opening provided in the printer carriage 109 to guide a luminous light 114 of the LED 105 to the light receiving sensor 105.

In the first embodiment, the LED 105 is mounted on the electric board 104 provided in the recording head 101, and an electric connection between the ink jet recording apparatus 100 and the LED 105 is made by wiring in the electric board 104.

The position of the LED 105 is not limited to this configuration. If the LED is positioned opposing the light receiving sensor 106 provided in the recording apparatus 100, it is possible to dispose the LED at any position on the recording head 101 by electric wiring.

Further, by guiding the light with the light guide member, flexibility in arranging the LED 105 can be enhanced.

The led 105 receives the supply of a driving voltage necessary for emission by the above described electric connection and performs the emission.

Although it is possible to allow the emission always with the recording apparatus 100 at power-on when the recording head 101 is mounted on the carriage 109, according to the present embodiment, the emission control is performed only when the position detection is required by the recording apparatus 100.

In this manner, it is possible to reduce power consumption at print waiting time and the like.

Since the recording head 101 is fixed to the printer carriage 109, the light emitting LED 105 provided in the recording head 101 makes a reciprocal motion along the encoder scale 107 together with the scanning of the printer carriage 109.

Following this reciprocal motion, the light receiving sensor 106 reads the positional information located on the encoder scale 107, and outputs a position detection signal.

Next, the encoder scale 107 will be described using FIG. 2.

Figure 2:
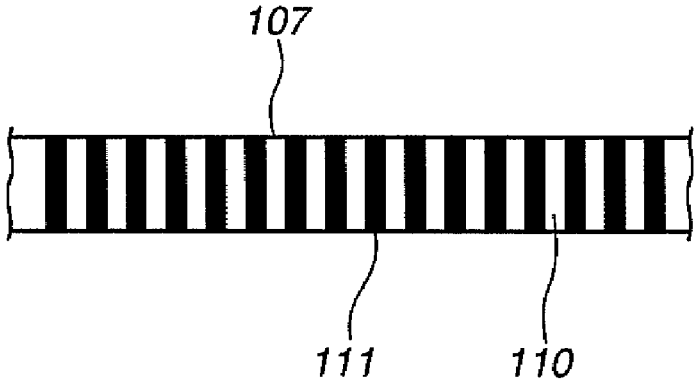
FIG. 2 is an explanatory view of an encoder scale.

In FIG. 2, marks 110 and 111 show the positional information on the encoder scale 107.

For example, the mark 110 is taken as an optical transmission portion, and the mark 111 as an optical reflecting portion (or non-transmission portion).

The light emitted by the LED 105 transmits the transmission portion 110, and is received by the light receiving sensor 106.

The light emitted by the LED 105 is blocked at the reflecting portion 111, and is not received by the light receiving unit sensor 106.

In such configuration, the output of the light receiving sensor 106 creates mutually opposite results at the transmission portion 110 and the reflecting portion 111.

The output from the light receiving sensor 106 is a pulse signal, and by counting this pulse signal, it is possible to detect the position of the printer carriage 109.

As described above, by providing the LED 105 in the recording head 101, at least one time replacement of the recording head 101 is performed within the life time of the ink jet recording apparatus 100.

Hence, it is possible to reduce piling of the contamination on the surface of the LED 105 by ink mist arisen at the printing time and other suspended matters inside the apparatus.

It is possible to prevent drop of the light emission amount of the LED 105 due to the contamination and malfunction of the recording apparatus 100 due to position detection errors of the printer carriage 109.

Further, since the LED 105 is arranged on the exchangeable recording head 101, it is not always necessary to provide a cover to prevent mist adhesion.

By detaching the recording head 101, it is possible to easily clean the LED 105.

The contamination by the ink mist and other suspended matters inside the apparatus and the like occurs also on the light receiving sensor 106 and the encoder scale 107 in addition to the LED 105.

According to an experiment conducted with the configuration according to the first embodiment, by resetting the contamination of at least one of the LED 105 and the light receiving sensor 106, the position detection failure of the printer carriage 109 has not occurred within the life of the recording apparatus 100.

Figure 3:
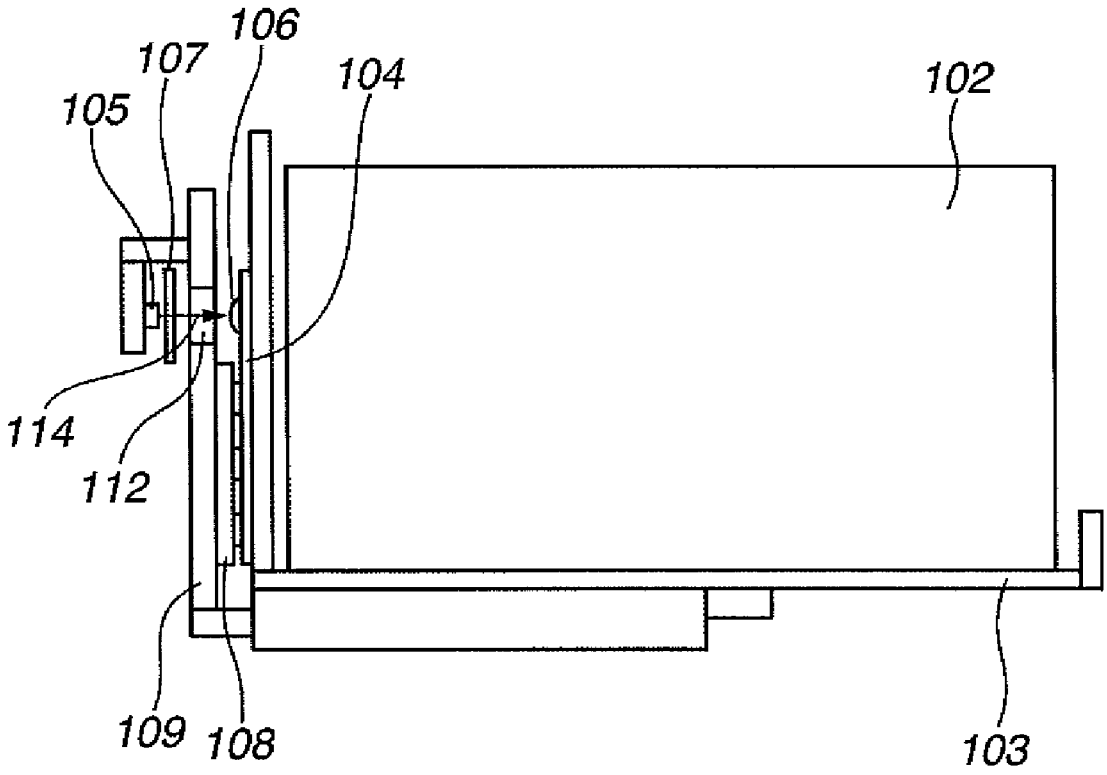
FIG. 3 is across sectional view in which the arrangement of a light emitting diode (LED) and a light receiving sensor is reversed in the ink jet recording head unit according to the first embodiment of the present invention.

FIG. 3 shows the arrangement of the LED 105 and the light receiving sensor 106 that reverses the configuration shown in FIG. 1.

In the present configuration, the output signal of the light receiving sensor 106 is outputted to the recording apparatus 100 through the electric board 104 and the connector board 108.

Also in the configuration of FIG. 3, it is possible to reduce the position detection failure of the printer carriage 109 within the life of the recording apparatus 100 by making the light receiving sensor 106 exchangeable.

Second Embodiment

Next, a second embodiment of the present invention will be described using FIG. 4. The second embodiment changes a position of the LED 105 in the configuration according to the first embodiment. The same component parts as the first embodiment will be identified with the same reference numerals, and the description thereof will be omitted.

Figure 4:
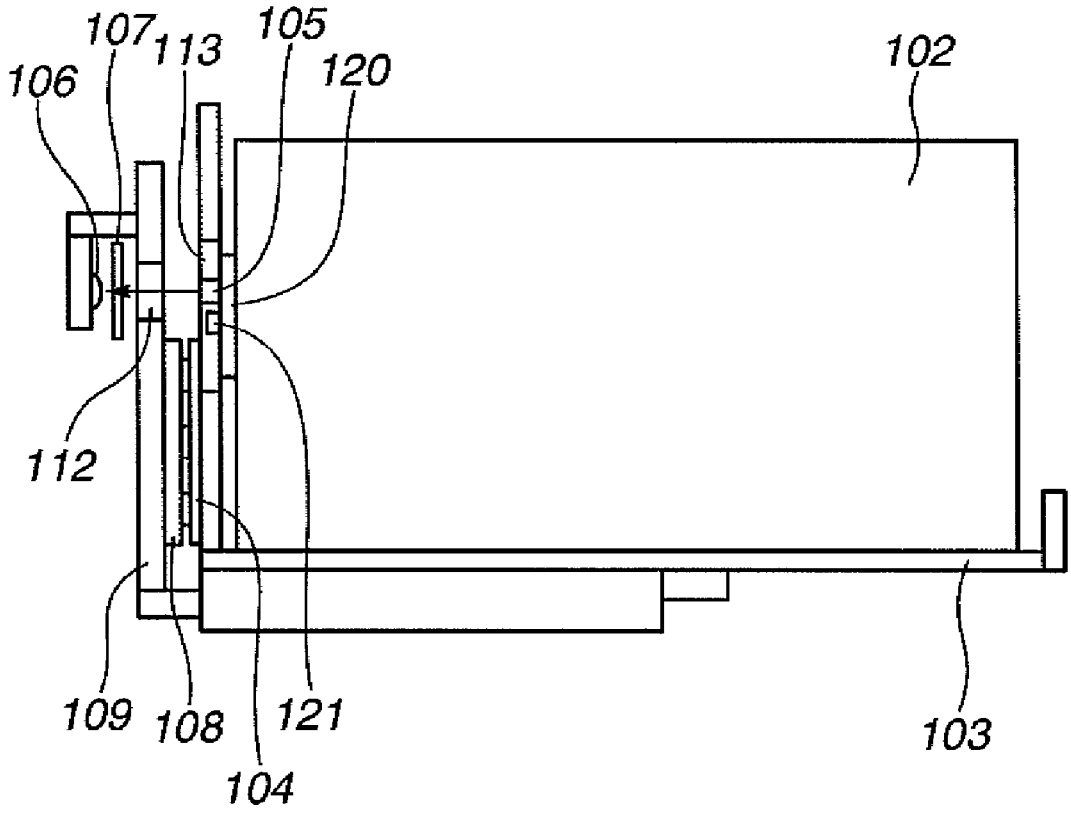
FIG. 4 is a schematic cross sectional view of an ink jet recording head unit according to a second embodiment of the present invention.

In the schematic cross sectional view of FIG. 4, reference numeral 120 denotes an electric board fixed to an ink tank 102 that includes an electric contact point connected to the electric board 104.

By mounting the ink tank 102 on the recording head, the LED 105 is configured in the ink tank 102 to correspond to a position opposed to the light receiving sensor 106 provided in the recording apparatus 100.

Further, the LED 105 can emit light only when the ink tank 102 is accurately mounted, and electrical connection between the electric board 104 and the electric board 120 is correctly performed.

Reference numeral 113 denotes an opening provided in the holder unit 103 to guide light of the LED 105 to the light receiving sensor 106.

In the second embodiment, the LED 105 is mounted on the electric board 120 provided in the ink tank 102.

Further, on the electric board 120, a storage element 121 that stores information relating to the ink tank 102 is mounted.

In this case, based on the information in the storage element 121, control of the LED 105 such as light emission amount adjustment and the like can be performed by the recording apparatus 100.

Further, together with confirmation of the electric connection between the electric board 104 and the electric board 120, the information in the storage element 121 may be confirmed by the recording apparatus 100. Thus, the recording apparatus 100 can recognize the case in which the ink tank 102 is erroneously mounted.

When the ink tank 102 is erroneously mounted, the recording apparatus 100 shuts down the operation or the like, thereby notifying the user of the erroneous mounting of the ink tank 102, so that print errors can be prevented in advance.

The driving power can be supplied from the storage element driving power by wiring within the control board.

The electric connection between the electric board 120 and the recording apparatus 100 is performed through the electric board 104 provided in the recording head 101. However, in the case where the electric contact point can be disposed on the recording apparatus 100, the electric board 120 and the recording apparatus 100 may be directly connected.

In the case where the mounting of the LED 105 on the electric board 120 is difficult due to the limitation imposed on the electric connection position, the electric contact point is constituted by an electric flexible cable.

By wiring of the electric flexible cable, it is possible to enhance the flexibility of the LED 105 position on the ink tank 102.

According to the present configuration, by providing the LED 105 in the ink tank 102 which is exchanged when the ink is consumed, it is possible to exchange the LED 105 in the quantitative printing in the recording apparatus 100.

Consequently, occurrence of the malfunction of the recording apparatus 100, which results from the contamination by ink mist, can be reliably prevented.

Figure 5:
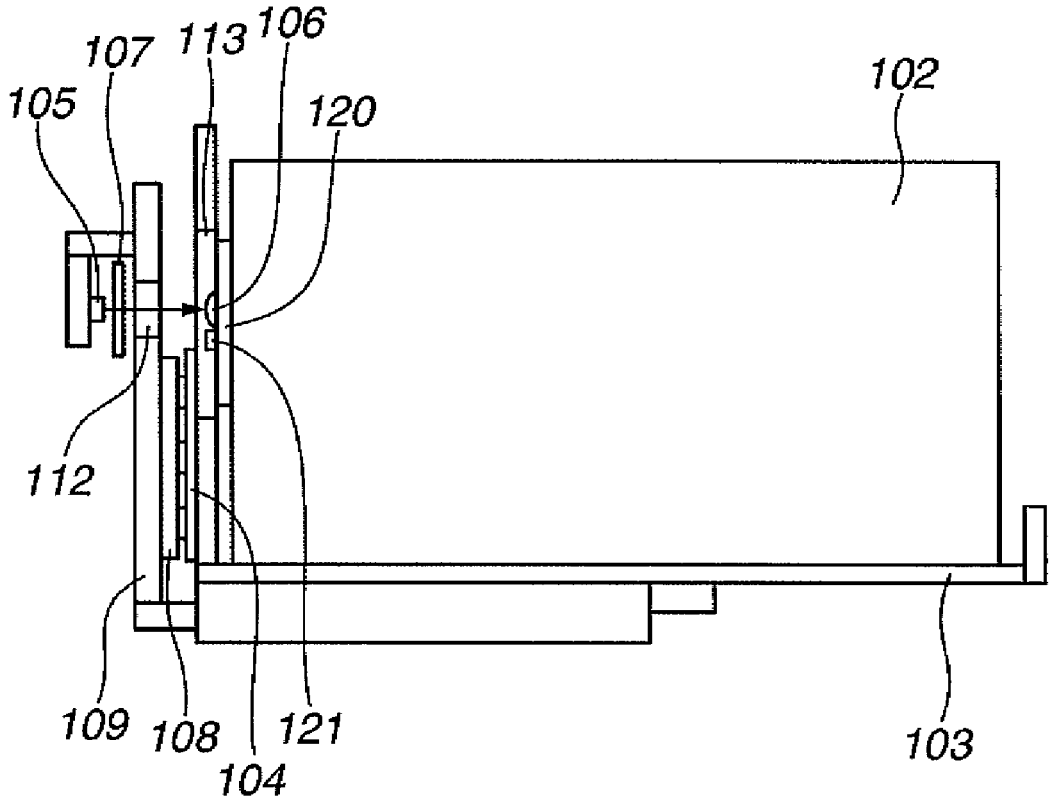
FIG. 5 is across sectional view in which the arrangement of a light emitting diode (LED) and a light receiving sensor is reversed in the ink jet recording head unit according to a second embodiment of the present invention.

FIG. 5 shows a configuration according to the second embodiment in which the arrangement of the LED 105 and the light receiving sensor 106 is reversed, as similar to the first embodiment.

With the above configuration, the same effect as described in the first embodiment can be obtained.

Third Embodiment

Next, a third embodiment of the present invention will be described in reference to FIG. 6.

The third embodiment changes the configuration with respect to positions of the LED 105 and the light receiving sensor 106 described in the first and second embodiments.

The same component parts as the first and second embodiments are identified with the same reference numerals and the description thereof will be omitted.

Figure 6:
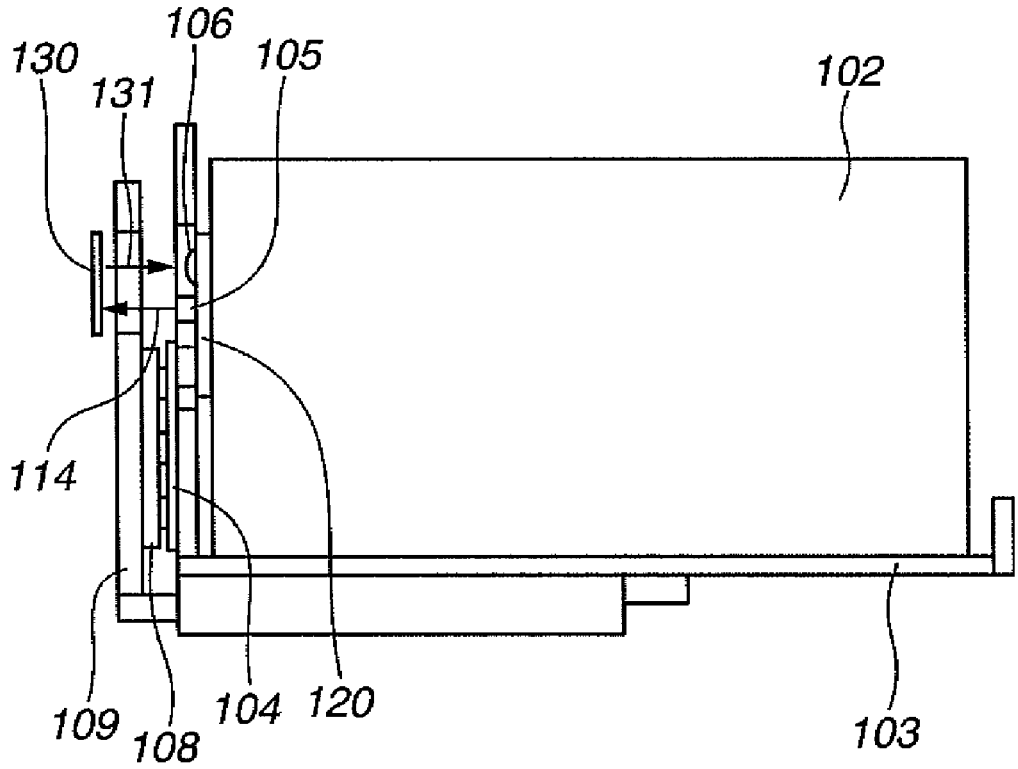
FIG. 6 is a schematic cross sectional view of an ink jet recording head unit according to a third embodiment of the present invention.

In the schematic cross sectional view of FIG. 6 that shows a portion of the cross section of an ink jet recording apparatus, reference numeral 130 denotes an encoder scale, which is a reflecting type scale having portions alternately showing high reflectance and low reflectance on a continuous film.

In the present configuration, the reflecting type encoder scale 130 is used, and both the LED 105 and the light receiving sensor 106 are provided on the ink tank 102. Though, according to the third embodiment, the LED 105 and the light receiving sensor 106 are provided on the ink tank 102, it is possible to provide them on the recording head 101.

A reflecting plate made of metalized resin film is used in the encoder scale 130.

A reflecting portion and a non reflecting portion are provided on this reflecting plate at predetermined pitches, and cord shaped patterns provided at uniform intervals are detected by the light receiving sensor 106 using difference of the reflectance.

By outputting the output value of the light receiving sensor 106 to the control unit (not shown) of the recording apparatus 100, the positional information of the carriage 109 is detected.

Thus, even in the case where the reflecting type encoder scale is used, the present invention is applicable.

While each of the above embodiments has described the optical linear encoder, the present invention is not limited to this, and for example, the invention is also adaptable to an optical rotary encoder.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

What is claimed is:

1. An ink tank used for an ink jet recording apparatus having a carriage operable to reciprocally move along a recording medium, and an optical encoder scale, wherein the ink tank is detachably attached to the carriage, the ink tank comprising:

an optical element configured to read the optical encoder scale, wherein the optical element is mounted on the ink tank, and the optical element is detachable from the carriage integrally with the ink tank, and wherein the optical element reads the optical encoder scale when the optical element reciprocally moves along the optical encoder scale integrally with the carriage to detect the position of the carriage.

2. The ink tank according to claim 1, wherein the optical element comprises a light emitting element configured to emit light to the optical encoder scale.

3. The ink tank according to claim 1, wherein the optical element comprises a light receiving element configured to receive light from the optical encoder scale.

4. The ink tank according to claim 1, further comprising an ink jet recording head configured to eject ink stored in the ink tank, wherein the ink jet recording head is attached to the ink tank.

5. An ink jet recording apparatus, comprising:

a carriage configured to reciprocally move along a recording medium;

an optical encoder scale;

an ink tank detachably attached to the carriage;

an ink jet recording head mounted on the carriage and configured to eject ink stored in the ink tank; and an optical element configured to read the optical encoder scale, wherein the optical element is mounted on the ink tank, and the optical element is detachable from the carriage integrally with the ink tank, and wherein the optical element reads the optical encoder scale when the optical element moves along the optical encoder scale integrally with the carriage to detect the position of the carriage.

6. The ink jet recording apparatus according to claim 5, wherein the optical element comprises a light emitting element configured to emit light to the optical encoder scale.

7. The ink jet recording apparatus according to claim 5, wherein the optical element comprises a light receiving element configured to receive light from the optical encoder scale.

* * * * *